US007416460B2

(12) United States Patent
Walczyk

(10) Patent No.: US 7,416,460 B2
(45) Date of Patent: Aug. 26, 2008

(54) MARINE SCREW DRIVE WITH LINE CUTTER

(76) Inventor: Stephen L. Walczyk, 2928 Ryan Rd., Weedsport, NY (US) 13166

( * ) Notice: Subject to any disclaimer, the term of this patent is extended or adjusted under 35 U.S.C. 154(b) by 0 days.

(21) Appl. No.: 11/642,209

(22) Filed: Dec. 20, 2006

(65) Prior Publication Data

US 2008/0153366 A1 Jun. 26, 2008

(51) Int. Cl.
*B63H 1/28* (2006.01)

(52) U.S. Cl. ..... 440/73

(58) Field of Classification Search ..... 440/73; 416/146 R

See application file for complete search history.

(56) References Cited

U.S. PATENT DOCUMENTS 3,371,720 A * 3/1968 Blanchard, Jr. ..... 416/146 R
4,450,670 A 5/1984 Robinson ..... 56/8
4,676,758 A 6/1987 Dennis ..... 440/73
4,801,281 A * 1/1989 Govan ..... 440/73
5,807,150 A 9/1998 Minter, Sr. ..... 440/73
7,008,277 B2 3/2006 Caulfield ..... 440/73

* cited by examiner

*Primary Examiner*—Stephen Avila
(74) *Attorney, Agent, or Firm*—Bernhard P. Molldrem, Jr.

(57) ABSTRACT

A line cutter in the form of an apertured disk or plate mounts onto the housing of a propeller drive or screw drive. The line cutter mounts over the propeller shaft, and covers the propeller shaft seal. The line cutter opening has a small clearance over the shaft which is smaller than a standard fish line gauge, i.e., about 0.002 inches. Fishline or other debris encountered by the screw drive winds around the shaft and winds back until it is torn, ground, or cut when it encounters the circular cutting edge at the small clearance. This line cutter is useful on a trash skimmer work boat.

15 Claims, 3 Drawing Sheets

MARINE SCREW DRIVE WITH LINE CUTTER

BACKGROUND OF THE INVENTION

This invention relates to propeller drives or screw drives for watercraft, and is more specifically concerned with a device to protect the screw drive from fish line or other debris in the water, which may wind around the shaft and damage the drive mechanism. The invention more particularly addresses problems of work boats and vessels, such as trash skimmers, that operate in areas where there is considerable amounts of debris in the water.

A problem arises where there are strands of fish line in the water, as the fish line can catch on the screw or propeller, and then wind around the propeller shaft as the shaft rotates. The fish line can wind back towards the housing where the shaft emerges, and can damage the rubber seal that surrounds the propeller shaft at that location. This can result in leakage of lubricants out of the housing and of water into the housing.

There have been several proposed solutions for cutting debris away from a propeller shaft. One typical solution is described in U.S. Pat. No. 7,008,277. There, a spool is mounted on the propeller to provide a place for the debris to wind up, and a cutter in the form of a knife or blade is mounted on the skeg or body of the motor to cut away the debris that accumulates on the spool. This approach has not proved to be reliable, and in addition it presents an exposed sharp edge.

OBJECTS AND SUMMARY OF THE INVENTION

Accordingly, it is an object of the invention to provide an effective and simple approach to removing debris from the shaft of a screw drive, which avoids the drawbacks of the prior art.

It is another object to provide a cutter arrangement of improved design which is unobtrusive and does not present an exposed edge, yet protects the propeller shaft seal from fish line or other debris that can wind around the shaft.

According to one aspect of this invention, a marine screw drive is provided with an improved line cutter for cutting away fishline or other debris that may wind around a propeller shaft of the screw drive. The screw drive has a drive housing, and the propeller shaft emerges through a shaft opening in the housing. The propeller shaft of circular section at the point where it emerges, and has a predetermined diameter. A seal member is disposed over the propeller shaft at the shaft opening to keep fluids from passing out from or into said housing, i.e., to hold lubricants in and keep water out.

The line cutter is mounted on the housing over the propeller shaft. The line cutter can be an apertured disk or plate with a circular opening that surrounds the shaft. The opening has a clearance over the shaft that is smaller than a predetermined thickness of a standard fishline. For example, a standard fishline is typically has a gauge of 0.007 inches or more, so the clearance provided by the line cutter is smaller than that. Then when the line winds around the shaft and winds back towards the seal, the small clearance at the line cutter grinds or tears the line. In a preferred embodiment, the clearance is about 0.002 inches.

In a preferred embodiment, the circular opening is beveled at an angle of about 20 degrees, to form a sharp circular edge.

The cutter can be a disk of a stainless steel, with a small circular flange at the outer edge. This can be sealed to the housing, to prevent corrosion. The cutter can be attached with machine screws of other fasteners.

The above and many other objects, features, and advantages of this invention will become apparent to persons skilled in the art from the ensuing description of a preferred embodiment, which should be considered in connection with the accompanying Drawing.

DETAILED DESCRIPTION OF A PREFERRED EMBODIMENT

Figure 1:
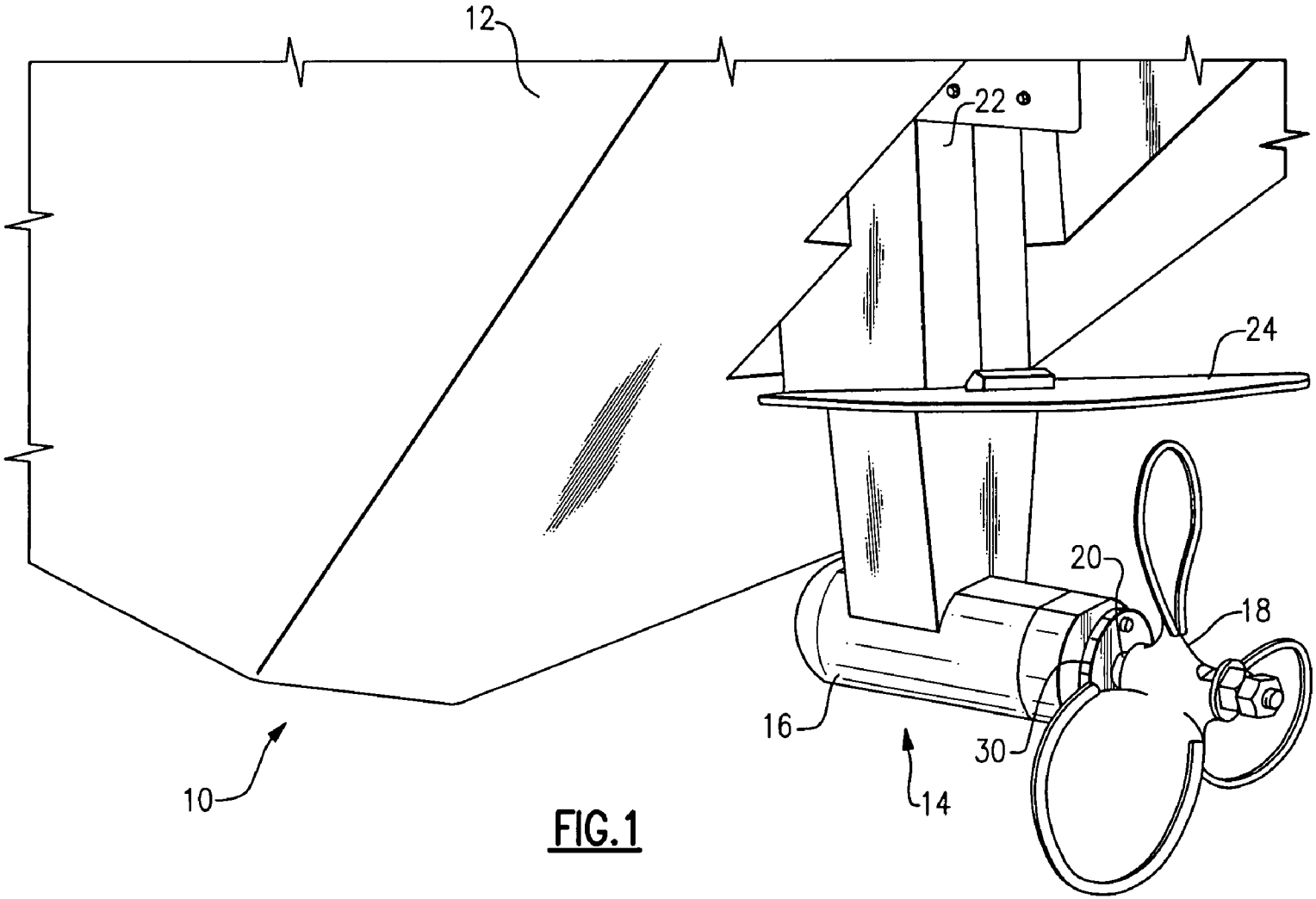
FIG. 1 is a perspective view of a portion of a trash skimmer boat showing a screw drive with line cutter according to one embodiment of the present invention.

With reference to the Drawing, and initially to FIG. 1 thereof, a perspective view of a portion of the stern of a trash skimmer boat or watercraft 10 with a hull element or float 12 and a propeller drive or screw drive 14 mounted at the stern of the hull element. Here, the screw drive has a housing 16 with a propeller or screw 18 mounted on a propeller shaft 20 that emerges to sternward from the housing 16. In one implementation, the housing contains a hydraulically powered motor and associated gear drive and bearings, to rotating the propeller 18 over a wide range of speeds. A vertical leg 22 of the screw drive 14 mounts to the stern of the hull element 12, and can include an elevator for adjusting the depth of the drive. An anticavitation plate 24 extends sternward over the propeller from the leg 22.

Figure 2:
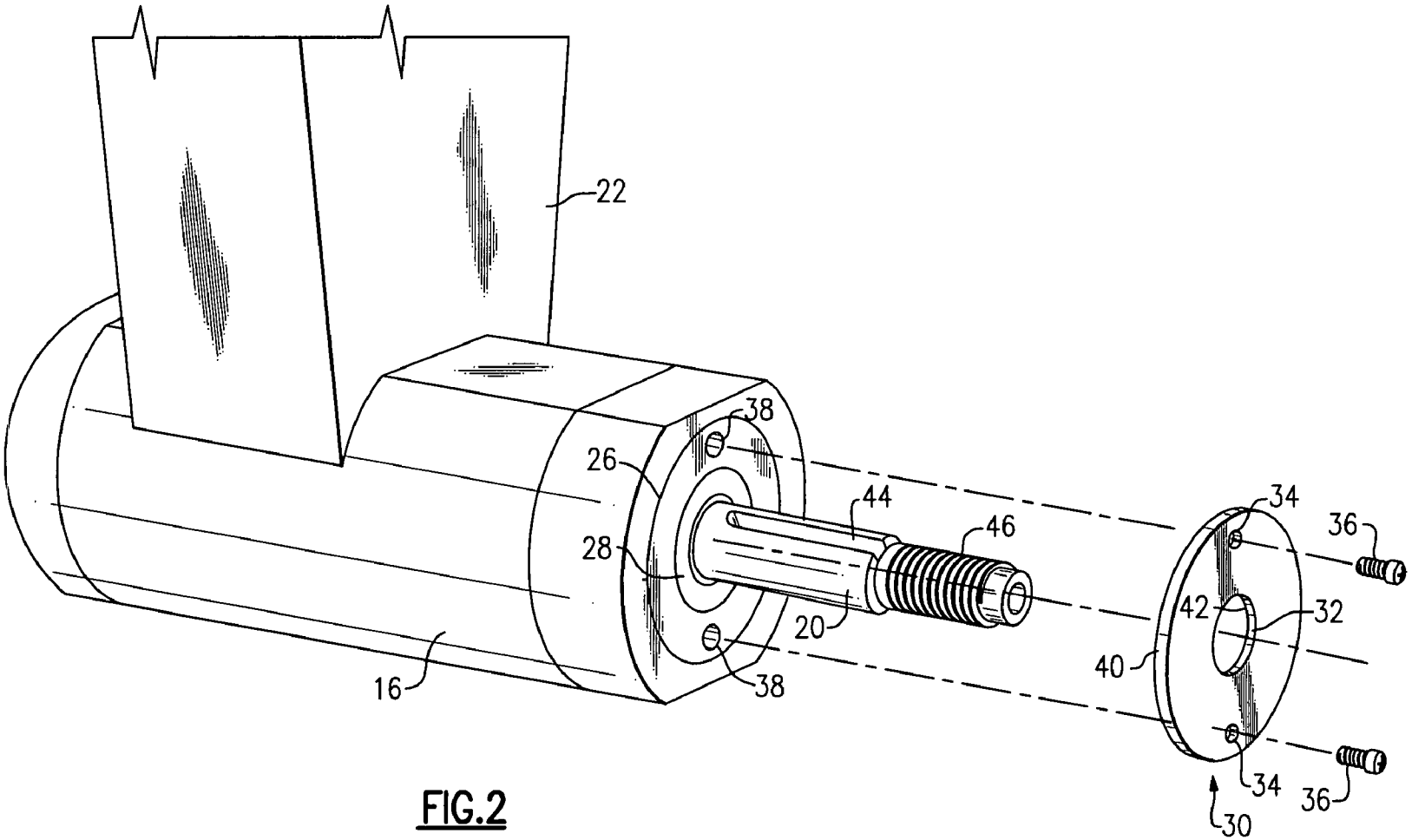
FIG. 2 is an exploded perspective assembly view of the screw drive, showing the line cutter.

As shown in FIG. 2, the screw drive housing 16 has a generally flat sternward face 26, and there is a flexible seal member 28 surrounding the propeller shaft 20 where it emerges through a shaft opening in the sternward face 26 of the housing. The propeller shaft 20 in this embodiment has a nominal diameter of 1.25 inches.

A debris cutter 30 in this embodiment takes the form or a round plate or disk, having a central opening 32 through which the propeller shaft passes. Here, the opening 32 is of a slightly greater diameter than the diameter of the shaft 20, so that the opening defines a small clearance over the shaft, on the order of about two thousands of an inch. The disk of the debris cutter 30 has a pair of holes 34 for attaching the cutter to the stern face 26, using a pair of machine screws 36 or similar fasteners. Threaded openings 38 are formed on the surface 26 to receive these screws.

Figure 3:
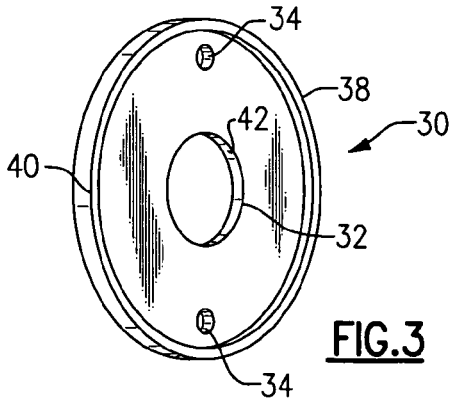
FIG. 3 is a perspective showing a proximal or housing-facing side of the line cutter.

The front of the debris cutter or line cutter 30 is shown in FIG. 3. There is an annular flange 40 at the outer edge of the disk of the cutter 30 that rests against the face 26 of the drive housing 16. Preferably, the circular opening 32 is tapered so as to form a sharp circular edge 42 at its distal or stern-facing side, to facilitate the cutting or tearing of fish line or other debris.

In a preferred application, the cutter 30 takes the form of a housing seal cover, and the portion of the disk adjacent the opening 32 rests against the seal member 28. The cutter 30 is sealed at the screw holes 34 and at the annular flange 40, to minimize the risk of corrosion occurring behind the cutter. The cutter 30 is preferably formed of a stainless steel.

Figure 4:
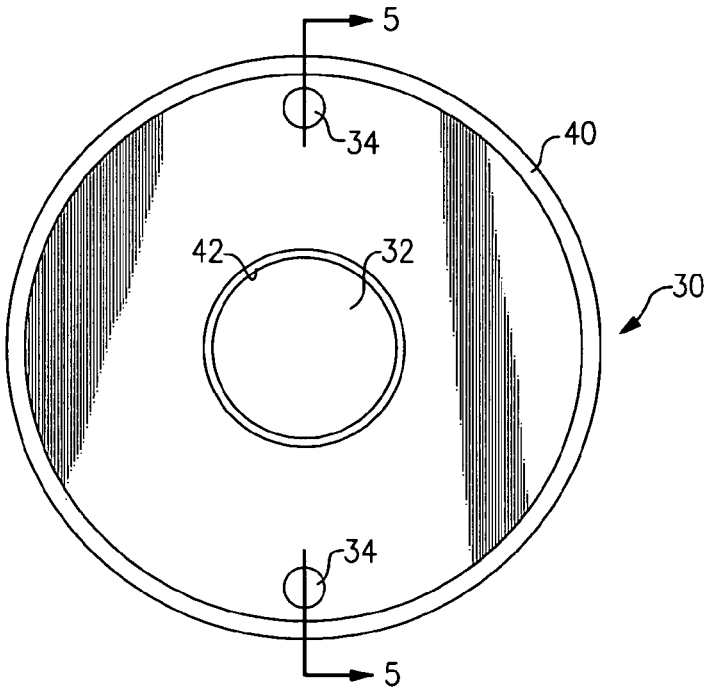
FIG. 4 is an elevation of the cutter of one embodiment.
Figure 5:
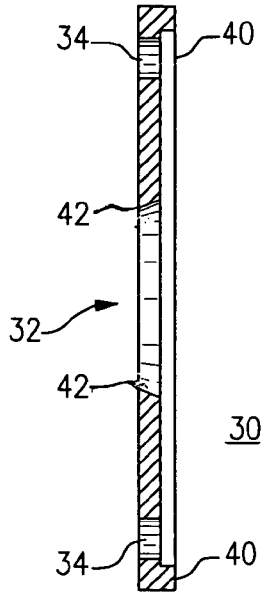
FIG. 5 cross section thereof taken at line 4-4 of FIG. 4.

Some details of the preferred embodiment of the debris cutter 30 (or seal cover) are illustrated in FIGS. 4 and 5. Here, the cutter 30 has a diameter of 4.0 inches, and the annular flange 40 has a depth of 0.10 inches. The central opening 32 has a diameter of 1.250 inches, and there is a taper of 20.0 degrees, forming the circular cutting edge 42. The opening 32 then defines a clearance of about 0.002 inches in respect to the propeller shaft 20. Any line, string, or other debris that winds around the shaft will be cut or torn when it encounters the small clearance and the sharp circular edge 42. String or fishline that is of a smaller gauge than two thousands of an inch will have a low tensile strength, and will come apart under the strains involved with winding up on the propeller shaft.

Returning to FIG. 2, the shaft 20 is shown to have a keyway 44 formed along one side to fit a corresponding key member in the propeller 18, and there is a male thread 46 formed at the distal end of propeller shaft, for receiving a nut to hold the propeller in place. The construction and functioning of these features is well understood, and does not require explanation in any detail.

As seen in FIGS. 2-5, there are no sharp projections on the cutter 30, and no sharp edges except the circular cutting edge 42.

Depending upon the design of the screw or propeller drive, the cutter or cover plate of this invention can take other forms or be formed of other materials. The cutter 30 is not limited only to circular plates or disks, but can be a square or oblong plate, or of an oval shape. Also, rather than a flat plate, in some applications the cutter can be of convex or concave configuration.

While the debris cutter of this invention has been described in reference to a preferred embodiment, it should be understood that the invention is not limited to that precise embodiment. Rather, many modifications and variations will present themselves to those skilled in the art without departing from the scope and spirit of the invention, as defined in the appended claims.

I claim:

1. A marine screw drive with line cutter for cutting away fishline or other debris that may wind around a propeller shaft of the screw drive, comprising a drive housing;

a propeller shaft of circular section and having a predetermined diameter, which emerges through a shaft opening in said drive housing;

a seal member disposed over said propeller shaft at said shaft opening to keep fluids from passing out from or into said housing; and a line cutter mounted on said housing, said line cutter having a flat, apertured portion surrounding said shaft and having a circular aperture forming a circular passage through which said propeller shaft passes, the passage having a clearance over said shaft of less than about 0.007 inches, so that said clearance is smaller than a predetermined thickness of a standard fishline, and such that the circular passage defines an annular surface facing said shaft and spaced by it by said clearance of less than about 0.007 inches, and with the annular surface having a taper so as to form a sharp circular cutting edge that serves to cut the fishline that winds around said shaft.

2. A marine screw drive with line cutter for cutting away fishline or other debris that may wind around a propeller shaft of the screw drive, comprising a drive housing;

a propeller shaft of circular section and having a predetermined diameter, which emerges through a shaft opening in said drive housing;

a seal member disposed over said propeller shaft at said shaft opening to keep fluids from passing out from or into said housing; and a line cutter mounted on said housing, said line cutter surrounding said shaft and having an opening through which said propeller shaft passes, the opening having a clearance over said shaft that is smaller than a predetermined thickness of a standard fishline; wherein said line cutter is in the form of a flat apertured plate mounted on said housing; and is free of projections or cutting edges other than at said opening, wherein any fishline or debris that winds around the propeller shaft is cut when it encounters said clearance.

3. A marine screw drive with line cutter for cutting away fishline or other debris that may wind around a propeller shaft of the screw drive, comprising a drive housing;

a propeller shaft of circular section and having a predetermined diameter, which emerges through a shaft opening in said drive housing;

a seal member disposed over said propeller shaft at said shaft opening to keep fluids from passing out from or into said housing; and a line cutter mounted on said housing, said line cutter surrounding said shaft and having an opening through which said propeller shaft passes, the opening having a clearance over said shaft that is smaller than a predetermined thickness of a standard fishline; wherein said line cutter is in the form of an apertured flat disk mounted on said housing; and is free of projections or cutting edges other than at said opening, wherein any fishline or debris that winds around the propeller shaft is cut when it encounters said clearance.

4. The marine screw drive with line cutter of claim 3 wherein said opening in said line cutter has a clearance over said shaft of less than 0.007 inches.

5. The marine screw drive with line cutter of claim 1 wherein said aperture in said line cutter has a clearance over said shaft of substantially 0.002 inches.

6. The marine screw drive with line cutter of claim 1 wherein said annular surface is beveled to form said circular cutting edge.

7. The marine screw drive with line cutter of claim 6 wherein the annular surface is beveled at an angle of substantially 20 degrees.

8. The marine screw drive with line cutter of claim 2 wherein said opening in said line cutter has a clearance over said shaft of substantially 0.002 inches.

9. The marine screw drive with line cutter of claim 2 wherein said opening defines an annular surface facing said shaft, which surface is beveled to form a circular edge.

10. The marine screw drive with line cutter of claim 9 wherein the annular surface at said opening is beveled at an angle of substantially 20 degrees.

11. The marine screw drive with line cutter of claim 3 wherein said opening in said line cutter has a clearance over said shaft of substantially 0.002 inches.

12. The marine screw drive with line cutter of claim 3 wherein said opening defines an annular surface facing said shaft, which surface is beveled to form a circular edge.

13. The marine screw drive with line cutter of claim 12 wherein the annular surface at said opening is beveled at an angle of substantially 20 degrees.

14. The marine screw drive with line cutter of claim 1 wherein said aperture is beveled such that the circular cutting edge is disposed at a stern-facing side of said line cutter.

15. The marine screw drive with line cutter of claim 1 wherein the cutter has a stern-facing surface extending from said aperture to a rim thereof, and said stern-facing surface is free of cutting edges between the aperture and the rim.

* * * * *